US011828063B2

(12) United States Patent
Zheng et al.

(10) Patent No.: US 11,828,063 B2
(45) Date of Patent: Nov. 28, 2023

(54) METHODS AND SYSTEMS FOR IMPARTING VISUAL FEATURES TO LIQUID APPLIED RESIDENTIAL ROOFS

(71) Applicant: Building Materials Investment Corporation, Dallas, TX (US)

(72) Inventors: Yan Zheng, Livingston, NJ (US); Yixi Xiao, Edison, NJ (US); Daniel E. Boss, Morris Township, NJ (US); Adem Chich, Kearny, NJ (US)

(73) Assignee: BMIC LLC, Dallas, TX (US)

( * ) Notice: Subject to any disclaimer, the term of this patent is extended or adjusted under 35 U.S.C. 154(b) by 164 days.

(21) Appl. No.: 17/037,356

(22) Filed: Sep. 29, 2020

(65) Prior Publication Data

US 2021/0095467 A1 Apr. 1, 2021

Related U.S. Application Data

(60) Provisional application No. 62/907,947, filed on Sep. 30, 2019.

(51) Int. Cl.

| | |
|---|---|
| ***E04B 7/18*** | (2006.01) |
| ***E04B 7/02*** | (2006.01) |
| ***E04D 11/02*** | (2006.01) |

(52) U.S. Cl.

CPC ..... *E04B 7/18* (2013.01); *E04B 7/02* (2013.01); *E04D 11/02* (2013.01)

(58) Field of Classification Search

CPC ..... E04B 7/18; E04B 7/02; E04D 7/00; E04D 11/02; E04D 13/147; E04D 12/002

See application file for complete search history.

(56) References Cited

U.S. PATENT DOCUMENTS 4,217,742 A * 8/1980 Evans ..... E04D 5/06 52/553

4,643,080 A 2/1987 Trostle et al.

(Continued)

FOREIGN PATENT DOCUMENTS

| | | |
|---|---|---|
| CA | 2530192 C | 2/2012 |
| EP | 2871053 A1 | 5/2015 |

(Continued)

OTHER PUBLICATIONS

Youtube: "How to Install TPO/PVC Coating I GAF Roof Mate"; https://www.youtube.com/watch?v=utrSOcyr-ol; dated Mar. 20, 2019.

(Continued)

*Primary Examiner* — Adriana Figueroa

(74) *Attorney, Agent, or Firm* — WOMBLE BOND DICKINSON (US) LLP

(57) ABSTRACT

Methods and systems for imparting visual features to a liquid applied roof, such as for forming a residential roof, include using overlapping strips of underlayment, underlayment with varying densities, underlayment with raised features, and underlayment with a gridded surface among others. Visual features also can be imparted by mixing different colors of a liquid applied roofing material, embedding floating particles in a liquid applied roofing material, embedding colored flakes in a liquid applied roofing material or spraying colored flakes onto a liquid applied roof before skinning, creating texture as the liquid applied roofing material is applied, and using stencils or printing techniques to impart visual features.

18 Claims, 7 Drawing Sheets

(56) References Cited

U.S. PATENT DOCUMENTS 4,668,315 A 5/1987 Brady et al.
4,909,135 A 3/1990 Greko
5,693,133 A 12/1997 Largent et al.
5,848,510 A * 12/1998 Grazman ..... E04D 5/12 52/409
7,024,829 B2 4/2006 Sharp et al.
7,272,915 B2 9/2007 Peng
7,285,183 B2 10/2007 Kajander et al.
7,765,763 B2 * 8/2010 Teng ..... E04D 1/36 52/552
7,882,670 B2 * 2/2011 West ..... E04D 13/1476 454/366
8,079,184 B2 12/2011 Wiercinski et al.
8,309,211 B2 11/2012 Mehta et al.
8,673,427 B2 * 3/2014 Kalkanoglu ..... E04D 1/20 428/40.1
8,689,510 B1 * 4/2014 Krumvieda ..... E04D 7/00 52/516
8,863,442 B2 10/2014 Freeman
9,334,655 B2 5/2016 Polumbus et al.
9,512,342 B1 12/2016 Gutman
9,551,152 B2 * 1/2017 Feuer ..... E04D 11/02
9,945,124 B2 4/2018 Baker
9,963,880 B2 5/2018 Kraus et al.
9,982,437 B2 * 5/2018 Barrego ..... E04D 12/002
10,253,502 B2 * 4/2019 Grube ..... B33Y 50/02
2003/0159379 A1 8/2003 Pickler
2005/0210808 A1 * 9/2005 Larson ..... E04D 5/10 52/518
2006/0059833 A1 * 3/2006 Pelzer ..... E04D 13/00 52/520
2006/0193995 A1 8/2006 Yong
2007/0079926 A1 * 4/2007 Mehta ..... B44C 3/02 156/219
2007/0281119 A1 * 12/2007 Di Stefano ..... E04D 12/002 428/40.1
2008/0008858 A1 1/2008 Hong et al.
2009/0013620 A1 1/2009 West
2011/0173908 A1 * 7/2011 Kahle ..... E04D 5/08 52/273
2011/0223410 A1 9/2011 Gencer et al.
2011/0252740 A1 10/2011 Hamlin, III
2013/0034721 A1 2/2013 Wang et al.
2014/0072751 A1 3/2014 Bradenburg
2014/0215963 A1 8/2014 Bradenburg et al.
2014/0259972 A1 9/2014 Feuer et al.
2015/0144250 A1 5/2015 Subotic et al.
2015/0240495 A1 8/2015 Vermilion et al.
2015/0361299 A1 12/2015 Byrne et al.
2016/0177480 A1 * 6/2016 Cady ..... B32B 27/32 442/203
2017/0002231 A1 1/2017 Haberle et al.
2017/0145697 A1 5/2017 Anthony
2018/0245348 A1 * 8/2018 Prygon ..... E04F 13/0885
2019/0292789 A1 9/2019 Mallick et al.
2021/0095473 A1 4/2021 Zheng et al.

FOREIGN PATENT DOCUMENTS

GB 2441054 A 2/2008
GB 2473681 A 3/2011
GB 2498138 A 7/2013
JP 2004-251102 A 9/2004
KR 100785333 B1 * 12/2007
KR 20090087979 A * 8/2009
WO WO2012/162845 A1 12/2012
WO WO2018/154427 A1 8/2018

OTHER PUBLICATIONS

International Search Report and the Written Opinion of the International Search Authority for PCT/US2020/053331, dated Dec. 31, 2020.

Apb Pole Barns; Author Unknown; Roof Pitch Explained; https://web.archive.org/web/20170606104758/https://www.pole-barn.info/roof-pitch.html; 2016.

* cited by examiner

METHODS AND SYSTEMS FOR IMPARTING VISUAL FEATURES TO LIQUID APPLIED RESIDENTIAL ROOFS

RELATED APPLICATION

The present Patent Application claims the benefit of previously filed, U.S. Provisional Patent Application Ser. No. 62/907,947, filed Sep. 30, 2019.

INCORPORATION BY REFERENCE

The specification and drawings of U.S. Provisional Patent Application Ser. No. 62/907,947, filed Sep. 30, 2019, are specifically incorporated by reference herein for all purposes as if set forth in their entirety.

TECHNICAL FIELD

This disclosure relates generally to roofing products for residential roofs and more particularly to liquid applied roofing materials used on residential or steep slope roofs. Other aspects also are described.

BACKGROUND

Liquid applied roofing can be used to form a watertight envelope across flat of low slope commercial roofs. There is a growing interest in using liquid applied roofing on steep slope residential roofs because of its reliability and durability. However, the monolithic, featureless appearance of liquid applied roofing materials on commercial roofs can be considered unsightly on residential roofs. A need exists for liquid applied roofing for residential and steep slope roofs that is visually more acceptable to the average homeowner. It is to the provision of methods and systems for achieving such roofing that the present disclosure is primarily directed.

SUMMARY

Briefly described, methods and systems are disclosed that impart a more aesthetic visual appearance and/or varying selected aesthetic visual features to a liquid applied roofing material for forming a residential roof or steep sloped roof or other structure. The visual appearance of the finished residential roof may mimic a traditional roof such as asphalt shingles or standing seam metal roofing. Alternatively, completely new looks can be achieved such as color patterns, a wood facade, an overlapping panel or other patterned appearance. One aspect of the present disclosure includes systems for imparting visual features to a liquid applied roof, particularly for forming on a steep slope residential roof or other similar sloped or pitched roof structure. Another aspect of the present disclosure includes methods for imparting visual features to a liquid applied roof, particularly on a steep slope residential roof.

By way of example, and without limitation, in one aspect, a method of forming a roof, such as a residential or similar steep slope roof, is provided, including applying an underlayment along a roofing substrate of a sloped roof having a substrate oriented at a selected pitch; and applying a liquid applied roofing material along the underlayment. The underlayment will comprise a material adapted to adhere to or at least partially absorb the liquid applied roofing material; and curing the liquid applied roofing material. A plurality of aesthetic visual features is defined along the sloped roof upon the curing of the liquid applied roofing material.

The liquid applied roofing material can comprise a translucent liquid sealant, and the underlayment comprises a pattern, image, design, folded or layered construction, or combinations thereof defining a least a portion of the plurality of aesthetic visual features. Upon curing of the liquid applied roofing, the pattern, image, design, folded or layered construction, or combinations thereof defines at least a portion of the plurality of aesthetic visual features and is visible through the liquid applied roofing material.

Applying the underlayment along the roofing substrate can comprise positioning a plurality of fabric strips along the roofing substrate in an overlapping alignment adapted to create at least a portion of the plurality of aesthetic visual features with an appearance of darker or lighter regions below the liquid applied roofing material.

The liquid applied roofing material can comprise a clear or translucent liquid sealant, and applying the underlayment along the roofing substrate can comprise positioning a sheet of fabric folded to define a series of overlapping regions along the roofing substrate to form at least a portion of the plurality of aesthetic visual features.

Applying the underlayment along the roofing substrate can comprise positioning a sheet folded to define peaks and valleys. Upon curing of the liquid applied roofing material, the peaks and valleys can define aesthetic visual features having an appearance of a corrugated or standing seam roof.

In addition, the method can comprise mixing the liquid applied roofing material with at least one additional liquid applied roofing material having a different color, hue or tint, and coating the underlayment therewith.

The method also can comprise mixing the liquid applied roofing material with a plurality of fillers, pigments, particles, granules, colors, or combinations thereof; and coating the underlayment therewith.

In one aspect, by way of example and without limitation, a method of forming a sloped roof is provided, and can include obtaining an underlayment; positioning the underlayment along a roofing substrate of the sloped roof in a configuration adapted to provide aesthetic visual features visible along roof; coating the underlayment with a liquid applied roofing material; and curing the liquid applied roofing material. The aesthetic visual features are visible through the liquid applied roofing material.

Positioning the underlayment along the roofing substrate can comprise folding the underlayment into a configuration adapted to provide a patterned appearance to the sloped roof after the underlayment is coated with the liquid applied roofing material.

Positioning the underlayment along the roofing substrate can comprise folding the underlayment in a configuration including to form peaks and valleys defining the aesthetic visual features; and upon curing of the liquid applied roofing material, the aesthetic visual features provide an appearance of a corrugated or standing seam roof.

The underlayment further can comprise a plurality of fabric strips. Also, positioning the underlayment along the roofing substrate can comprise arranging the plurality of fabric strips in an overlapping alignment to define at least a portion of the aesthetic visual features including lighter or darker appearing areas when viewed through the liquid applied roofing material.

The underlayment can comprise an image, pattern, color, design, or combinations thereof printed onto the underlayment.

In addition, coating the underlayment with a liquid applied roofing material can comprises mixing a first liquid applied roofing material with at least one additional liquid applied roofing material having a different color, hue or tint, to form a mixed liquid applied roofing material; and applying the mixed liquid applied roofing material to the underlayment.

Positioning the underlayment along the roofing substrate can comprise applying the underlayment over the roofing substrate with at least a portion of the underlayment overlapping a roof mounted structure positioned along the roofing substrate; and coating the underlayment can comprise coating at least a portion of the roof mounted structure with the liquid applied roofing material.

These and other features, aspects, and advantages of the disclosed methods and systems of the present disclosure will become more apparent upon review of the detailed description set forth below in conjunction with the annexed drawing figures, which are briefly described as follows.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

DETAILED DESCRIPTION

Figure 1:
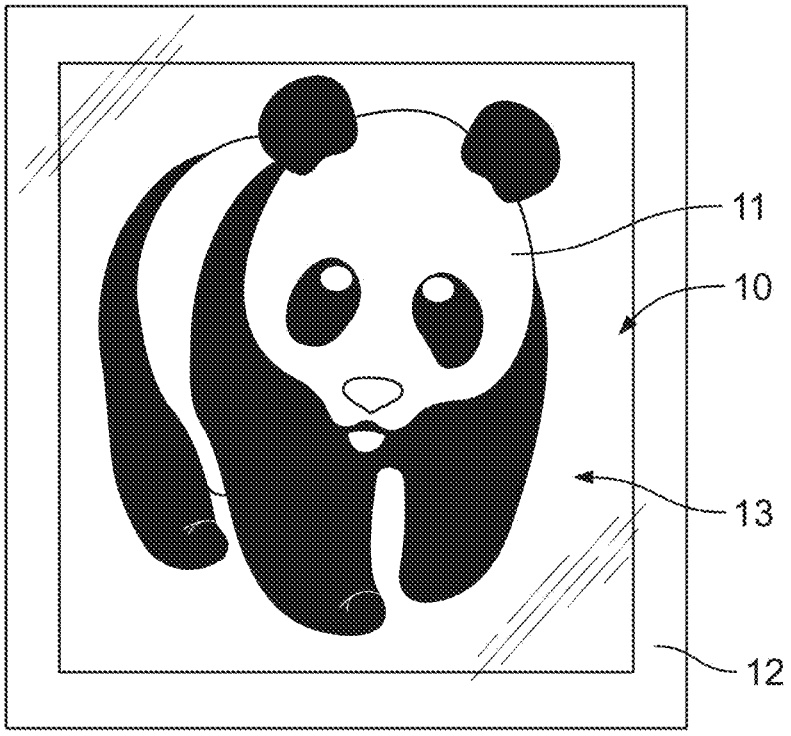
FIG. 1 illustrates an example of a visual feature including a printed image that can be imparted to a liquid applied residential roof according to an embodiment of the present disclosure.

Methods and systems for forming and imparting visual features to liquid applied residential roofs and/or other, similar types of roof structures, including steep slope and/or pitched roofs with a slope angle or pitch of 20°-30° or greater, will now be illustrated through various embodiments shown in the accompanying figures and described below. The following description, taken in combination with the accompanying figures is provided to assist in understanding the teachings disclosed herein. While the description is directed to specific implementations and embodiments of the teachings of the present disclosure, and is provided to assist in describing the teachings, such implementations and embodiments should not be interpreted as a limitation on the scope or applicability of the teachings of the present disclosure.

Throughout the description, the term "liquid applied roofing material" or "liquid roofing material" refers to any of a number of liquid applied roofing materials available on the market such as, for example, TOPCOAT® brand liquid applied roofing available from GAF of Parsippany, NJ More generically, the term may refer to a liquid applied roofing formulation with viscosity between 100 centipoise ("CPS") and 10,000,000 CPS and containing 20% to 100% weight percentage of resin materials. Unless otherwise specified, the viscosities detailed herein are measured at 70 degrees Fahrenheit.

In some embodiments, the liquid applied roofing materials can include formulations with viscosities between 100 CPS to 1,000,000 CPS; 100 CPS to 500,000 CPS; 100 CPS to 100,000 CPS; 100 CPS to 50,000 CPS; 1,000 CPS to 10,000 CPS; 5,000 CPS to 50,000 CPS; 10,000 CPS to 100,000 CPS; 50,000 CPS to 500,000 CPS; or 100,000 CPS to 1,000,000 CPS. In addition, the liquid applied roofing materials can include resin materials in ranges of 20% to 90%; 20% to 80%; 20% to 70%; 20% to 60%; 20% to 50%; 20% to 40%; 20% to 30%; 30% to 90%; 30% to 80%; 30% to 70%; 30% to 60%; 30% to 50%; 30% to 40%; 40% to 90%; 40% to 80%; 40% to 70%; 40% to 60%; 40% to 50%; 50% to 90%; 50% to 80%; 50% to 70%; 50% to 60%; 60% to 90%; 60% to 80%; 60% to 70%; 70% to 90%; 70% to 80%; or 80% to 90%.

Resin materials for use with or as a part of the liquid applied roofing materials may include, without limitation, polysiloxane, polyurea, polyurethane, silane modified ether, silane modified ester, silane modified polyurethane, silane modified polyurea, epoxy, acrylic, poly acrylic, or any precursors that will crosslink after application to form such polymers, or any combination of the above. A "liquid applied roof" is a roof resulting from the application of a liquid applied roofing material.

The terms "fabric," or "underlayment fabric," or "underlayment," or terms of similar import may refer to a woven or non-woven material, a mesh, an open-cell foam, or similar material to which a liquid applied roofing material sticks or into which a liquid applied roofing material soaks, or that is at least partially soluble in a liquid applied roofing material when applied. These terms include composite structures containing woven or nonwoven material, meshes, open cell foam, or similar material. Fabrics are generally used as a base layer or incorporated into underlayments that can be applied over a roofing substrate or deck as a base layer for liquid applied roofing material. In embodiments, the fabric has a sufficiently low density to allow for the liquid applied roofing material to penetrate the entire thickness of the fabric. In embodiments, the fabric has a density of 10 to 30 grams per square meter; 10 to 25 grams per square meter; 10 to 20 grams per square meter; 10 to 15 grams per square meter; 15 to 30 grams per square meter; 15 to 25 grams per square meter; 15 to 20 grams per square meter; 20 to 30 grams per square meter; 20 to 25 grams per square meter; or 25 to 30 grams per square meter. In some embodiments, the fabric is formed of polyester, polypropylene, fiberglass, polyethylene, polyamide, polyimide or combinations thereof. In embodiments, the fabric includes a metal mesh material.

According to the principles of the present disclosure, visual features can be imparted to a liquid applied roof in a number of varying ways, as illustrated by the drawing figures. In one embodiment illustrated in FIG. 1, a base layer 10 including a fabric or underlayment with an image 11 (simply for purposes of illustration, a panda is shown in FIG. 1). The image 11 can be applied such as by being printed, drawn, or otherwise applied to a surface of the fabric base layer. Thereafter, the base layer 10 can be rolled, laid or otherwise installed on or applied to a roof substrate 12 as an underlayment. The base layer 10 then is coated with a clear or translucent liquid applied roofing material 13. The image 11 (e.g. the panda) is visible through the liquid applied roofing material after curving to form resulting liquid applied roof. The images formed or applied to the base layer 10 can be separate or individual images that can be applied at selected locations or to sheets or strips of base layer fabric or underlayment materials, or can be applied and/or arranged as part of an overall patterned appearance for the liquid applied roof.

Figure 2A:
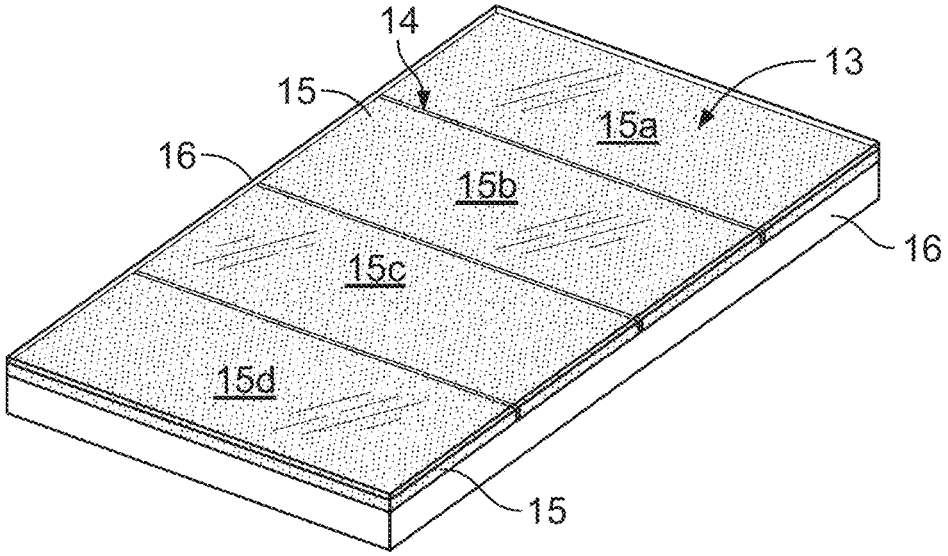
FIGS. 2A-2B illustrate other examples of visual features, including a base layer with folded or overlapping panels for imparting an appearance of shading and/or horizontal ridges to a liquid applied residential roof according to another embodiment of the present disclosure.
Figure 2B:
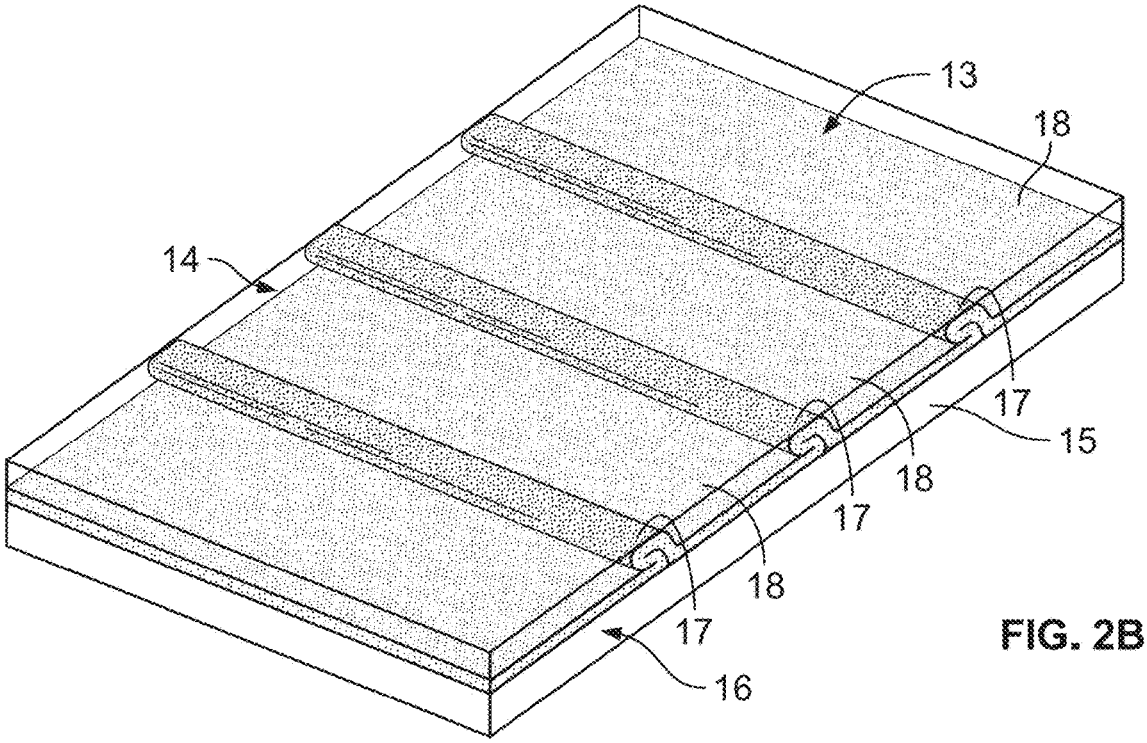

In another embodiment, generally illustrated in FIGS. 2A-2B, shows formation of visual features 14 by configuring a base layer 15 comprising a sheet of a fabric or underlayment laid over a roofing substrate or deck 16. In FIG. 2A, a series of fabric strips 15A-15D are shown with the strips 15A-15D arranged or positioned over the roofing substrate 16 in parallel overlapping alignment as an underlayment, over which the liquid applied roofing material 13 is deposited, such as by coating, spraying, rolling or other application method. The liquid applied roofing material can wet, soak or otherwise be absorbed into the fabric strips, which can encapsulate and secure the fabric strips to the roofing substrate or deck (with or without the use of additional fasteners, adhesives, etc.) creating a waterproof membrane structure along the residential roof the roofing substrate. This arrangement of overlapping strips imparts a layered appearance to the liquid applied roofing material and to the resultant liquid applied roof upon curing.

FIG. 2B illustrates an alternative arrangement whereby visual features imparted by a base layer 15 comprising a fabric or underlayment having parallel strips 17 that are denser than a surrounding fabric material 18 of the base layer. These strips 17 may be formed by folding the fabric base layer 15 over onto itself to form the strips. The denser strips impart three-dimensional stripe patterns with different shading, i.e. darker and lighter areas indicated at 17/18, after the liquid applied roofing material 13 is applied to the base layer and cured. Further, when a clear liquid applied roofing material is used, the denser stripes appear darker than the surrounding fabric at the base layer, providing an intensity variation that becomes a visible feature of the finished liquid applied roof as well.

In some embodiments, the base layer fabric can be folded or otherwise manipulated to form a distorted or non-flat surface, which, after the liquid applied roofing material is applied and cured, can create varying shading and other visual features. In other embodiments, the base layer fabric can be folded or otherwise manipulated to form a predetermined pattern visible after application of a liquid applied roofing material to the fabric. In yet other embodiments, the base layer fabric can be manipulated to vary the density or thickness of the base layer fabric to achieve a specific aesthetic visual features, such as color, hue, tint or staining after application of a liquid applied roofing material to the fabric.

Figure 3A:
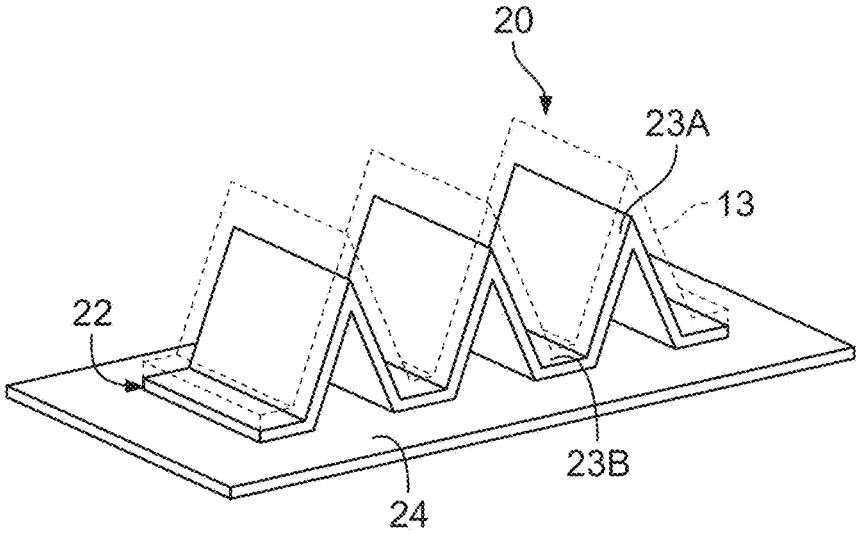
FIGS. 3A-3C illustrate examples of the formation of visual features including vertical corrugations and features of a standing seam roof, imparted to a liquid applied residential roof according to another embodiment of the present disclosure.
Figure 3B:
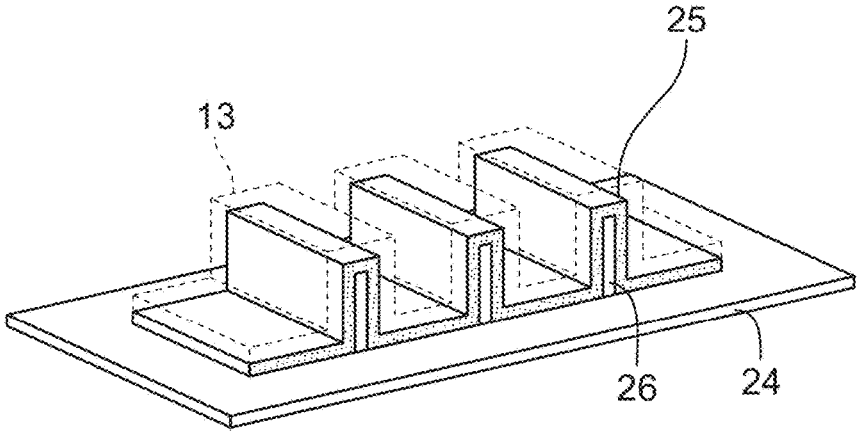
Figure 3C:
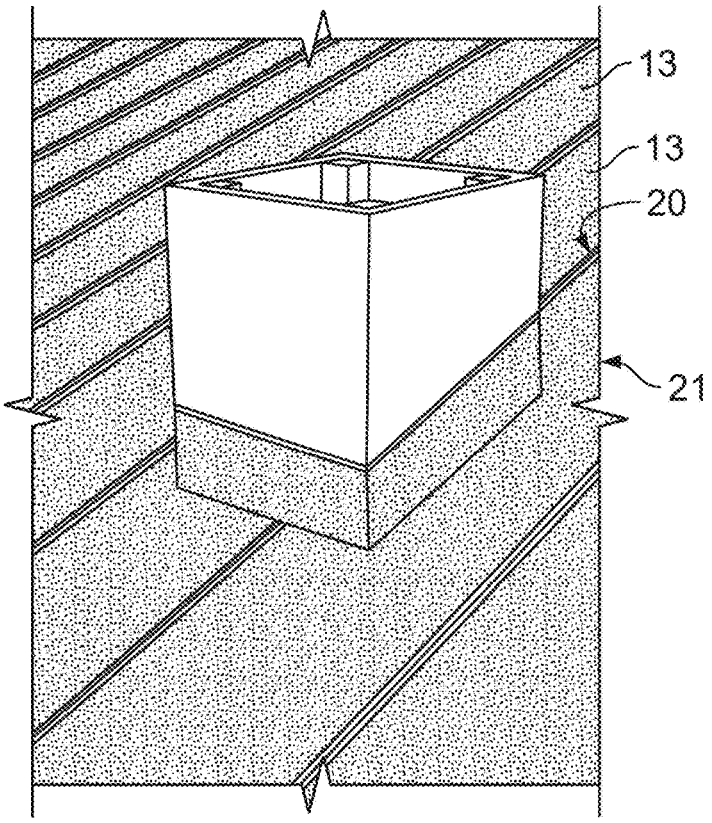

FIGS. 3A-3C illustrate an embodiment wherein visual features 20 for a residential roof 21 (FIG. 3C) can be formed by applying a liquid applied roofing material to a base layer 22 comprising an underlayment, such as a fabric or similar flexible material that has been folded into various three-dimensional shapes or configurations. For example, in FIG. 3A, the base layer 22 is folded in an origami fashion to form peaks and valleys 23A/23B. The folded base layer then can be positioned along a roofing substrate 24, and after the liquid applied roofing material has been applied and cures over the fabric bas layer, it resembles a traditional corrugated tin roof. The base layer 22 can be folded on-site prior to installation or can be pre-formed/pre-folded in a selected configuration and will be installed over a roofing substrate or deck.

FIG. 3B illustrates visual features 20 mimicking a traditional standing seam roof. In this example, a base layer 25 including fabric underlayment incorporates/covers a series of spaced parallel battens 26 that will run vertically down a sloped roof such as shown in FIG. 3C. When the liquid applied roofing material 13 is applied to the fabric and battens of the base layer 25, both the fabric and battens become encased in a resulting membrane when the material cures. As seen in FIG. 3C, this can create a liquid applied roof 21 that mimics a traditional standing seam metal roof.

Figure 4:
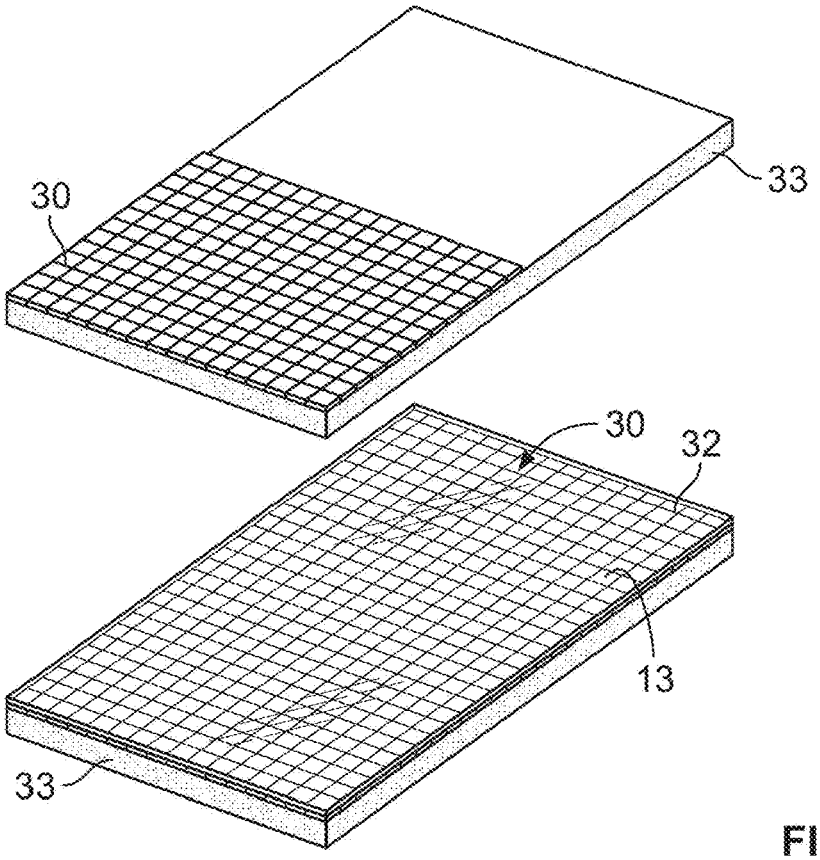
FIG. 4 illustrates the use of an underlayment base layer and liquid applied roofing material to impart atheistic visual features and/or a visual appearance configured to mask defects in a roof deck for a residential roof according to embodiments of the present disclosure.

FIG. 4 illustrates a further embodiment wherein the base layer 30 comprises a fabric underlayment or composite material, which can have an enhanced rigidity, such as a mesh or other, similar material formed of a metal, composite or other rigid material that is permeable or otherwise configured to allow the base layer 30 to soak or be wetted with a liquid applied roofing material 13. The base layer 30 is applied across the roofing substrate or deck 32 so as to span defects in the roof deck, such as seams, cracks, and knotholes, indicated at 33. After the base layer 30 is secured to the roof deck, the liquid applied roofing material 13 will then be deposited or applied, such as by spraying, rolling or coating the base layer, such that the defects are smoothed over and concealed. The system and method of this embodiment can be used in conjunction with other embodiments disclosed herein to ensure that underlying defects in the roof deck do not show through the finished liquid applied roof.

Figure 5A:
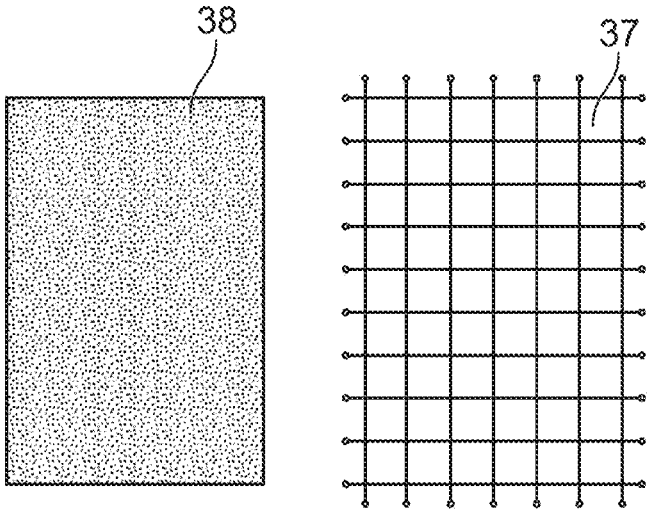
FIGS. 5A-5C illustrate another embodiment including the use of an underlayment base layer and liquid applied roofing material configured to impart atheistic visual features such as a grid pattern, according to the principles of the present disclosure.
Figure 5B:
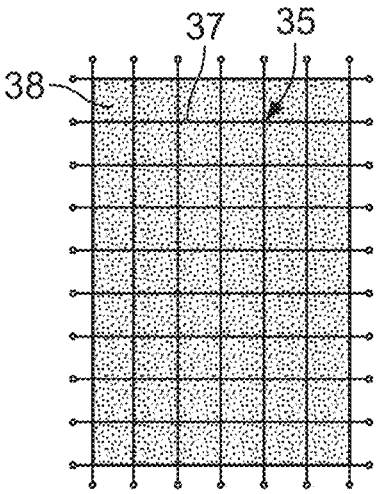
Figure 5C:
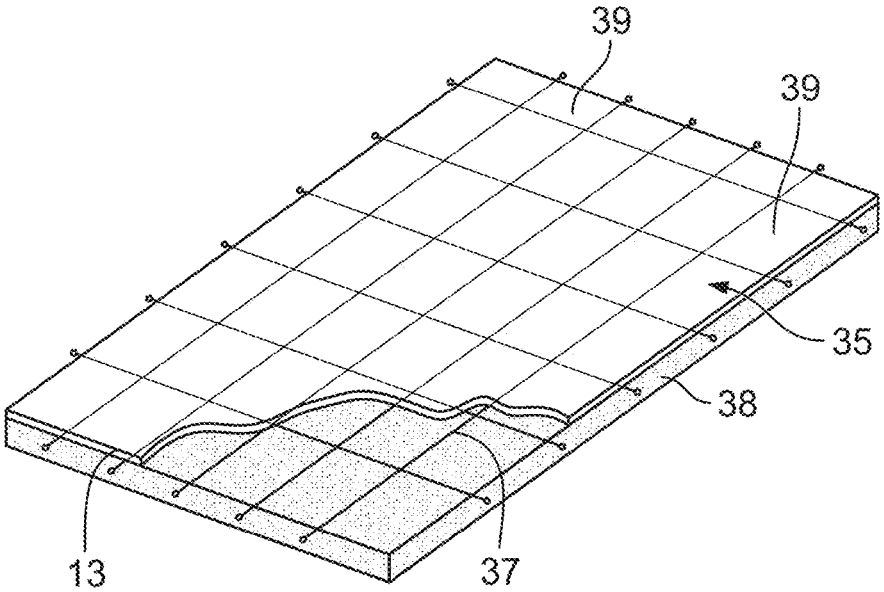

FIGS. 5A-5C illustrates visual features for a residential roof that include visual features 35 shown as grid patterns that can be formed by applying a liquid applied roofing material 13 (FIG. 5C) over a base layer that can include an appropriately sized mesh 37 positioned on top of a fabric underlayment layer 38. FIG. 5A shows a fabric underlayment 38 and the mesh 37. FIG. 5B shows the fabric 38 and the mesh 37 layered together. FIG. 5C shows the visual features 35 formed when a liquid applied roofing material 13 is applied to the resulting composite base layer. Strips 39 of fabric also are shown in an overlapped configuration in FIG. 5C to form, in conjunction with the gridded pattern, a layered look.

Figure 6:
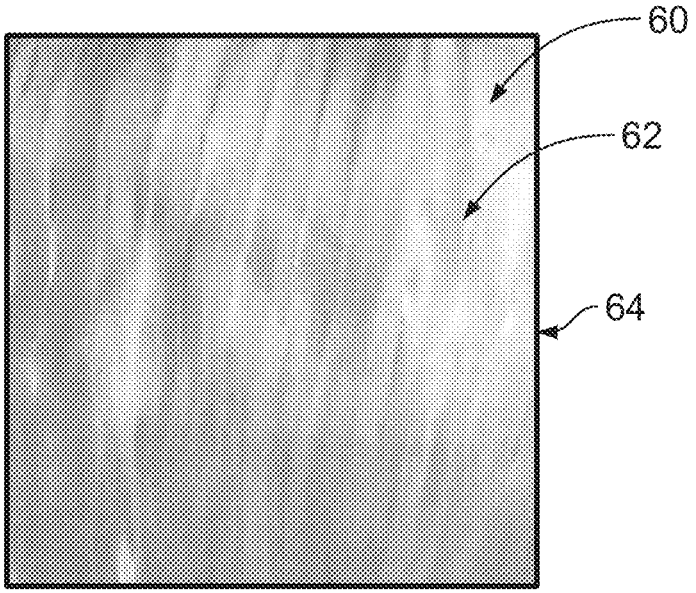
FIG. 6 illustrates formation of visual features including a color pattern imparted to a liquid applied residential roof according to an embodiment of the present disclosure.

FIG. 6 illustrates a visual feature 60 that can be formed on a roof by applying a liquid applied roofing material or materials of two or more different colors. For example, liquid applied roofing materials 62 of different colors, tints, or hues can be combined or mixed, and the mixture while applied still in its liquid state in situ over a base layer/substrate 64 to form a residential roof with varying colors or hues. Additional visual features can be formed by delivering more than one liquid applied roofing material having different colors in a progressively changing ratio. This embodiment may not mimic a traditional roof, but illustrates how the systems and methods of the present disclosure can be used to impart visual features to liquid applied residential roofs so as to create completely new and/or customized visual appearances for residential roofs.

Figure 7A:
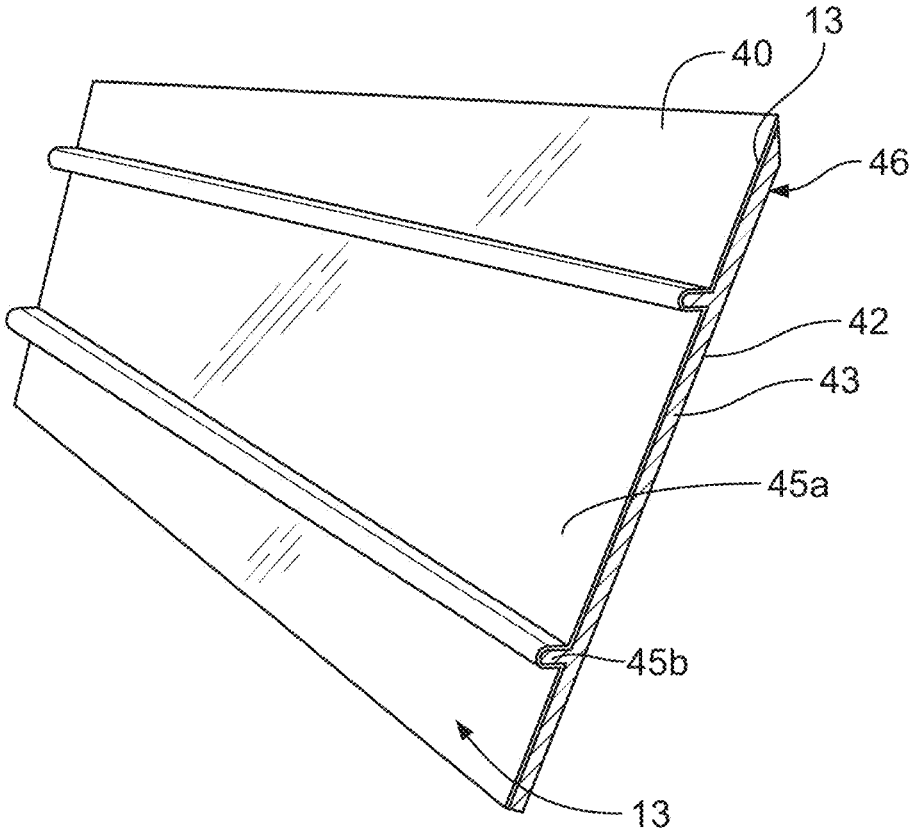
FIGS. 7A-7D illustrate another embodiment for forming a liquid applied residential roof having visual features, including a woodgrain pattern, granulated appearance, and/or a standing seam pattern or appearance imparted to the liquid applied residential roof according to the principles of the present disclosure.

FIG. 7A-7D illustrates an embodiment of a system and method for imparting visual features 40 to a liquid applied residential roof 41 (FIG. 7C) by introducing fillers, pigments or other particles into a liquid applied roofing material. FIG. 7A illustrates an embodiment wherein visual features 40 are formed by formulating a liquid applied roofing material 42 with floating pigment particles 43 that will move due to gravity or applied shear force after application to a base layer and/or a roofing substrate before the liquid applied roofing material cures. This creates visual color or other patterns on a liquid applied roof.

Figure 7B:
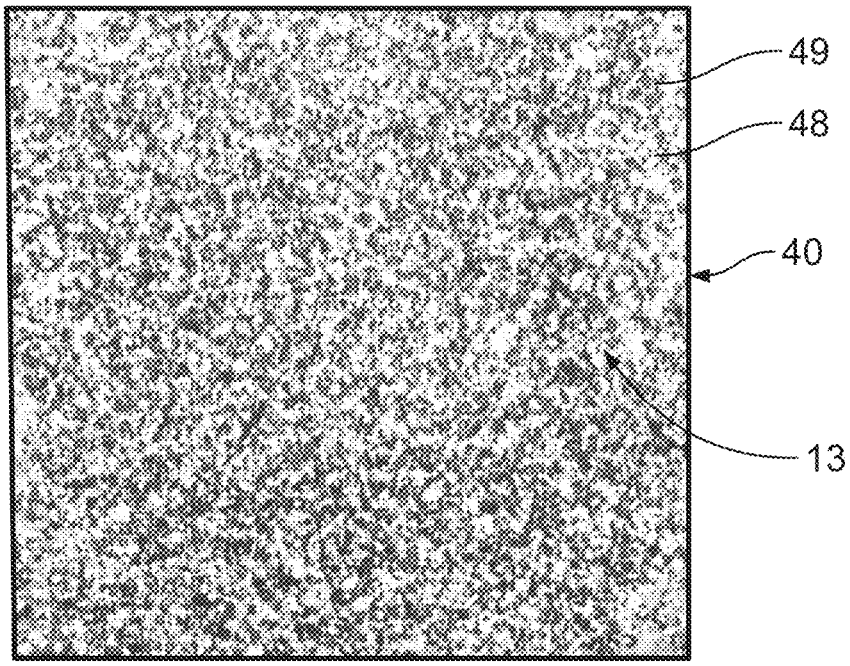

For example, FIG. 7A illustrates a woodgrain pattern 45*a* and a standing seam pattern 45*b* imparted to a roofing substrate 46 for a liquid applied residential roof 41. In FIG. 7B, metallic colored mica particles 47 were incorporated into the liquid applied roofing material 13. The mica particles 47 moved within the liquid applied roofing material 13 during roll application to impart a visual wooden-like appearance to the finished liquid applied roof.

Visual features can also be imparted by formulating a liquid applied roofing material with one or more fillers. Such fillers may include, for example, colored quartz particles; glass beads or spheres; plastic beads, flakes, or spheres; metal flakes; mineral particles among others. FIG. 7B shows a visual feature 40 imparted to a liquid applied roof material or base layer 48 by adding plastic flakes with white, black, and blue colors 49 into a clear liquid applied roofing material 13. This creates a granular pattern that can be configured to mimic granules on a traditional shingled roof. Of course, other colors and mixtures of colors can be used to impart visual granule features of different hues and colors to the finished liquid applied roof.

Figure 7C:
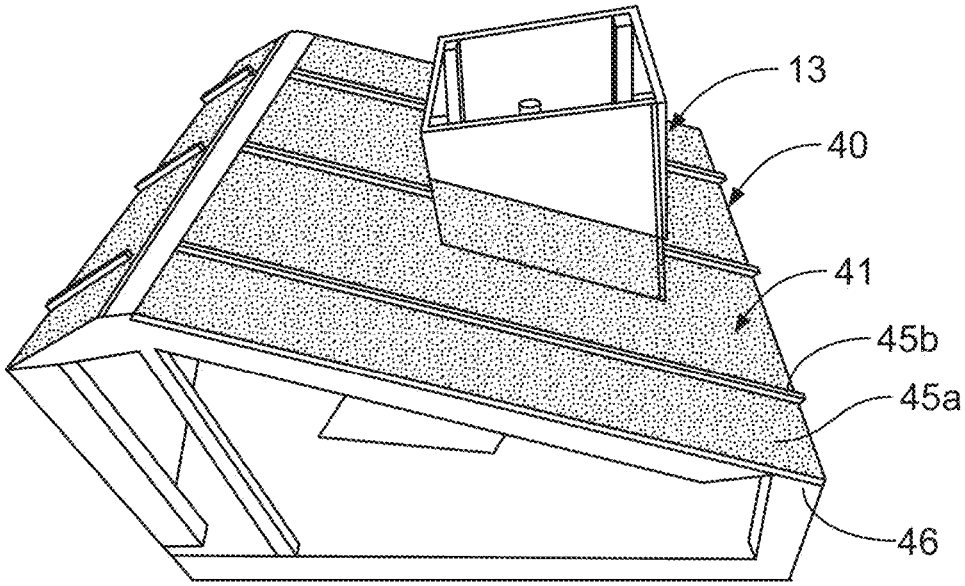

FIG. 7C illustrates an example of a section of a liquid applied residential type/sloped roof 41 to which a standing seam 45*b* visual feature has been imparted, and to which additional granular visual features 45*a* also have been imparted by addition of fillers to the liquid applied roofing material 13 as discussed above. As an alternative to adding fillers to a liquid applied roofing material, colored components, or patterning features can be added after a liquid applied roofing material has been applied. For example, colored flakes or granules can be sprayed onto a liquid applied roof immediately after application and before the liquid applied roofing material skins over, thereby imparting a granular visual feature.

Figure 7D:
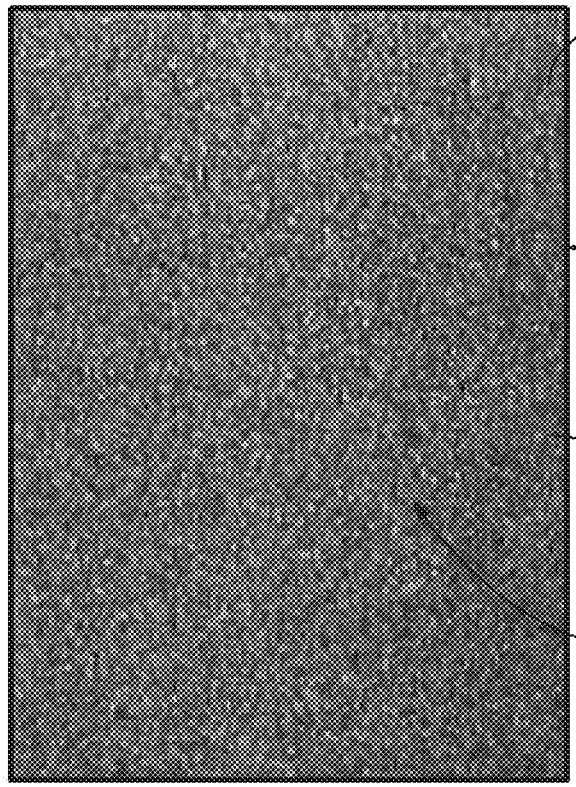

FIG. 7D illustrates a further example of visual features 40 formed according to the present embodiment, including dark colored granules or particles imparted to a liquid applied residential roof by spraying particles onto the liquid applied roofing material 13 during or after application to the roofing substrate and/or base layer, and before curing or setting of the liquid applied roofing material.

Figure 8:
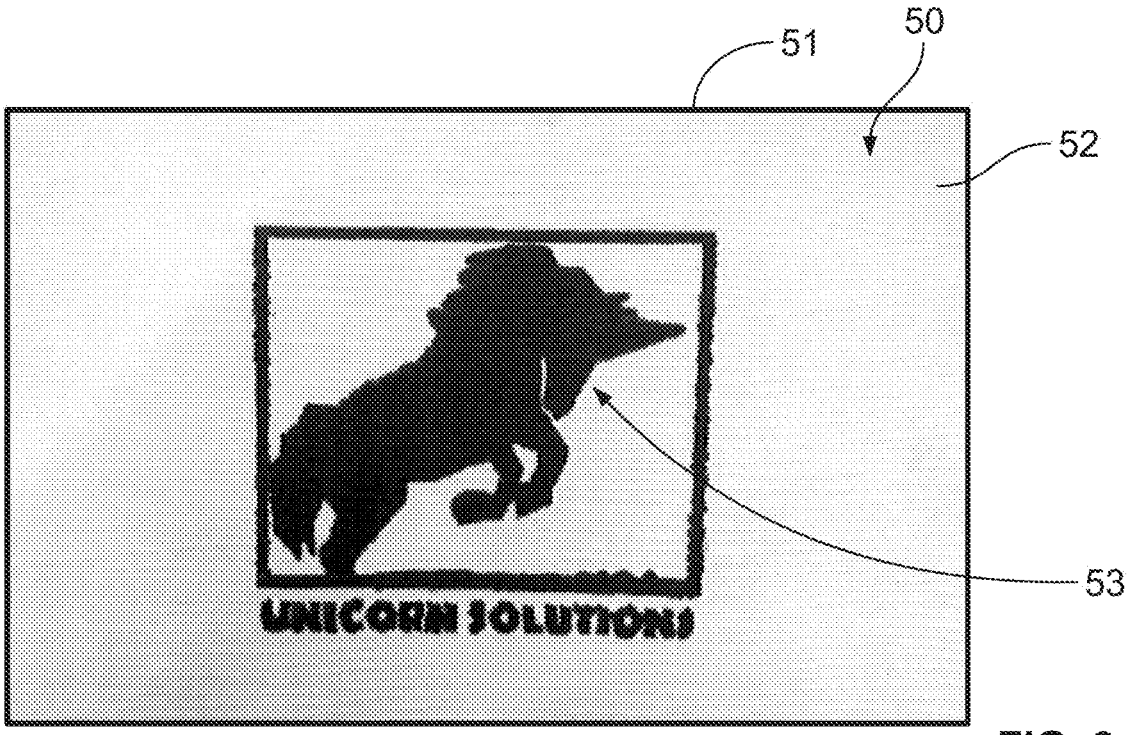
FIG. 8 illustrates still another example of visual features, including texture and an image, that can be imparted to a liquid applied roofing material for a residential roof using a stencil according to an embodiment of the present disclosure.

Textures also can be created as an aspect of the application process by which the liquid applied roofing material is applied or deposited. In FIG. 8, for example, a white liquid applied roofing material 50 was applied to a base layer or directly to a roofing substrate material 51 using a roller embossed with an array of spaced circumferential lines to create a horizontal strip or trowel-mark pattern 52 on the substrate. When the white liquid applied roofing material cured, a stencil was used to apply a further visual feature 53, in this case an image of a unicorn, to the white liquid applied roof. This technique is not limited to images, but also can be used to impart visual features that mimic traditional shingles, shadows, the illusion of texture or depth, or any other visual feature.

Modern large scale digital printing techniques also can be used to impart visual features to a liquid applied roof. For instance, an underlayment web may be printed with visual features and textures that mimic traditional asphalt shingles or other roofing products. When a clear liquid applied roofing material is applied to such an underlayment, the printed-on features become visible through the resulting membrane to add visual interest to the roof.

The term "roofing" is used herein is meant to encompass commercial or residential roof structures, including sloped or pitched roofs (e.g., having a slope between 30 degrees and 180 degrees); flat roofs; or roofs that include sloped/pitched portions and flat portions. However, embodiments of the present disclosure are not limited to commercial or residential roofing structures, and are applicable to a variety of building structures and building components. For example, in addition to roofing structures or systems, various embodiments and features of the systems and methods can be used with walls, such as perpendicular, slanted or slope walls or partitions, permanent and temporary partitions, beams, columns, slabs, etc., or other features or components of commercial, residential, temporary or other building structures. Still further, embodiments of the present disclosure also can be uses with other structures or structural components, such as for use with vehicle structures, e.g. motor vehicle structures and components (e.g., vehicle body, chassis, or other structural components of a motor vehicle), aerial vehicle structures and components (e.g., fuselage, wings, airfoil or other structural component of an aerial vehicle), or maritime vehicles and components (e.g., hull, propeller/rotor, or other structural component of a maritime vehicle).

Various systems and methods for imparting visual features to residential roofs and other types of roofing formed using a liquid applied roofing materials, including sloped or pitched roofs, have been described in the foregoing description in terms of non-limiting examples and embodiments of carrying out such systems and methods for imparting visual features to residential roofs and other types of roofing formed using a liquid applied roofing material according to the principles of the present disclosure. It will be clear to the skilled artisan that a wide gamut of additions, deletions, and modifications, both subtle and gross, may be made to the illustrated embodiments, without departing from the spirit and scope of the systems and methods for imparting visual features to residential roofs and other types of roofing formed using a liquid applied roofing material of the present disclosure exemplified thereby.

The invention claimed is:

1. A roof system, comprising:

a roofing substrate;

wherein the roofing substrate is oriented at a pitch of at least 30 degrees;

a base layer positioned along the roofing substrate;

a liquid applied roofing material applied to the base layer; and wherein the base layer comprises a woven material, nonwoven material, mesh, open cell foam, or a combination thereof, configured to at least partially absorb the liquid applied roofing material;

a plurality of aesthetic visual features defined along at least a portion of the base layer;

wherein the liquid applied roofing material comprises a clear or translucent liquid sealant material;

wherein the liquid applied roofing material configured to seal the base layer and form an exposed surface of the roof system upon curing;

wherein at least a portion of the aesthetic visual features are visible through the liquid applied roofing material upon the curing of the liquid applied roofing material;

wherein the base layer is configured to absorb the liquid applied roofing material such that the liquid applied roofing material penetrates the base layer and into contact with the roofing substrate sufficient to secure the base layer to the roofing substrate without fasteners or adhesives.

2. The roof system of claim 1, wherein the aesthetic visual features comprise a pattern, image, design, folded or layered construction, texture, or combinations thereof.

3. The roof system of claim 1, wherein the base layer comprises a plurality of fabric strips; and wherein at least a portion of the fabric strips are configured to define an appearance of a peak, valley, shingles, a corrugated or standing seam roof, or combinations thereof.

4. The roof system of claim 1, wherein the base layer comprises a plurality of fabric strips; and wherein at least a portion of the fabric strips are arranged in an overlapping alignment configured to define lighter or darker appearing areas when viewed through the liquid applied roofing material.

5. The roof system of claim 1, wherein the clear or translucent liquid sealant material of the liquid applied roofing material comprises polysiloxane, polyurea, polyurethane, silane modified ether, silane modified ester, silane modified polyurethane, silane modified polyurea, epoxy, acrylic, poly acrylic, precursors configured to crosslink after application to form a polymer, or combinations thereof.

6. The roof system of claim 1, wherein the liquid applied roofing material further comprises a dye, pigment, fillers, or combinations thereof, configured to provide the liquid applied roofing material with a color, hue, texture, pattern, or combinations thereof.

7. The roof system of claim 1, further comprising an additional liquid applied roofing material applied to the base layer, the additional liquid applied roofing material configured to form at least a portion of the aesthetic visual features.

8. The roof system of claim 1, wherein the liquid applied roofing material comprises a mixture of a plurality of liquid applied roofing materials, each having a different color or hue.

9. The roof system of claim 1, wherein the base layer comprises a density of 10 grams per square meter to 30 grams per square meter.

10. A roof system, comprising:

a roofing substrate oriented at a pitch of at least 30 degrees;

a base layer positioned along the roofing substrate;

a plurality of aesthetic visual features defined along at least a portion of the base layer; and a liquid applied roofing material applied to the base layer, the liquid applied roofing material comprising a clear or translucent liquid sealant material adapted to substantially seal the base layer and form an exposed surface of the roof system upon curing;

wherein the base layer comprises a woven material, nonwoven material, mesh, open cell foam, or a combination thereof, configured to at least partially absorb the liquid applied roofing material;

wherein at least a portion of the aesthetic visual features are visible through the liquid applied roofing material upon the curing of the liquid applied roofing material;

wherein the base layer is configured to absorb the liquid applied roofing material such that the liquid applied roofing material penetrates the base layer and into contact with the roofing substrate sufficient to secure the base layer to the roofing substrate without fasteners or adhesives.

11. The roof system of claim 10, wherein at least some of the aesthetic visual features comprise a pattern, image, design, texture, or combinations thereof.

12. The roof system of claim 10, wherein the base layer comprises a plurality of fabric strips; wherein at least a portion of the fabric strips are arranged parallel to one another, folded, layered, or combinations thereof, so as to define an appearance of a peak, valley, shingles, a corrugated or standing seam roof, or combinations thereof.

13. The roof system of claim 10, wherein the base layer comprises a plurality of fabric strips; wherein at least a portion of the fabric strips are arranged in an overlapping alignment to define lighter or darker appearing areas when viewed through the liquid applied roofing material.

14. The roof system of claim 10, wherein the clear or translucent liquid sealant material of the liquid applied roofing material comprises polysiloxane, polyurea, polyurethane, silane modified ether, silane modified ester, silane modified polyurethane, silane modified polyurea, epoxy, acrylic, poly acrylic, precursors configured to crosslink after application to form a polymer, or combinations thereof.

15. The roof system of claim 10, wherein the liquid applied roofing material further comprises a dye, pigment, fillers, or combinations thereof, configured to provide the liquid applied roofing material with a color, hue, texture, pattern, or combinations thereof.

16. The roof system of claim 10, further comprising an additional liquid applied roofing material applied to the base layer, the additional liquid applied roofing material configured to form at least a portion of the aesthetic visual features.

17. The roof system of claim 10, wherein the liquid applied roofing material comprises a mixture of a plurality of liquid applied roofing materials, each having a different color, tint or hue.

18. The roof system of claim 10, wherein the aesthetic visual features include printing or textures applied along the base layer and configured to create an appearance of a roofing shingle, roofing tile, or combinations thereof.

* * * * *